US011203397B2

(12) United States Patent
Miller

(10) Patent No.: US 11,203,397 B2
(45) Date of Patent: Dec. 21, 2021

(54) DINGHY MADE FROM SEPARATE FLOATING ELEMENTS

(71) Applicant: Clifton Leigh Miller, Swanport (AU)

(72) Inventor: Clifton Leigh Miller, Swanport (AU)

( * ) Notice: Subject to any disclaimer, the term of this patent is extended or adjusted under 35 U.S.C. 154(b) by 0 days.

(21) Appl. No.: 16/486,826

(22) PCT Filed: Dec. 5, 2017

(86) PCT No.: PCT/AU2017/051332

§ 371 (c)(1),
(2) Date: Aug. 19, 2019

(87) PCT Pub. No.: WO2018/148778

PCT Pub. Date: Aug. 23, 2018

(65) Prior Publication Data

US 2019/0367133 A1 Dec. 5, 2019

(30) Foreign Application Priority Data

Feb. 17, 2017 (AU) ..... 2017900525
Mar. 14, 2017 (AU) ..... 2017900878

(51) Int. Cl.
*B63B 7/04* (2020.01)
*B63B 7/00* (2020.01)

(52) U.S. Cl.
CPC ..... *B63B 7/04* (2013.01); *B63B 2007/006* (2013.01)

(58) Field of Classification Search
CPC .. B63B 7/02; B63B 7/04; B63B 34/20; B63B 34/23; B63B 2007/006; B63B 34/21
USPC ..... 114/343, 347, 352, 354, 355
See application file for complete search history.

(56) References Cited

U.S. PATENT DOCUMENTS 3,822,427 A * 7/1974 Ewart, Jr. ..... B63B 7/04 114/352
3,916,468 A * 11/1975 Tetreault ..... B63B 7/04 114/352
4,522,145 A * 6/1985 Stone ..... B63B 7/04 114/352
5,349,918 A * 9/1994 Elie ..... B63B 7/04 114/352
6,662,743 B1 * 12/2003 Rolfe ..... B63B 7/04 114/344
2008/0308030 A1 * 12/2008 Strus ..... B63B 7/04 114/352
2011/0146561 A1 * 6/2011 McLean ..... B63B 7/04 114/352

FOREIGN PATENT DOCUMENTS

GB 2090563 A * 7/1982 ..... B63B 7/04

* cited by examiner

*Primary Examiner* — Daniel V Venne
(74) *Attorney, Agent, or Firm* — Michael D. Eisenberg

(57) ABSTRACT

A dinghy constructed of two separable sections, being a front and a rear section, and a connection means adapted to join the two sections together. The front section has a rear bulkhead, the rear section has a front bulkhead the connection means integral with the bulkheads. One of the bulkheads includes cylindrical sleeves, the other bulkhead cylindrical rods adapted to engage the sleeves to thereby connect the dinghy together.

11 Claims, 9 Drawing Sheets

DINGHY MADE FROM SEPARATE FLOATING ELEMENTS

FIELD OF THE INVENTION

The present invention relates to a boat and in particular to a dinghy made from two or more parts, each part able to float on its own.

BACKGROUND TO THE INVENTION

There are many reasons why a small boat or dinghy that can be assembled from two or more separate sections presents a useful article. For example, most vessels such as yachts that have a keel usually also have a dinghy since the yacht in some places can only be moored a distance away from the shore and a dinghy is required to reach land. The advantages of having a dinghy also lead to the disadvantage of the dinghy taking up space on the parent vessel deck. A dinghy that can be split into two or more parts is thus inherently easier to stow. This is also true of dinghies that are stored in residential areas and transported to water using a vehicle. Not only is a dinghy that comes in several parts easier to store but it is also easier to transport.

In addition, in situations where transporting a whole dinghy is difficult for one reason or another (perhaps from a road to a water body that has no launching ramp or other easily accessible area to which to transport a whole dinghy by conventional conveyance means such as a trailer or wheeled vehicle) the ability to transport half a dinghy at a time for reassembly on or near the water becomes readily apparent as providing considerable advantage to the user.

Two-piece dinghies are known where the two pieces are attached to each other typically by bolts that join the two adjacent ends of the respective halves of a dinghy. The assembly either takes place on land before the launch of the assembled dinghy or while upon a vessel where it may even involve the need to stand one part on its end then raise the other over the head so to speak to achieve a gravity-hold while bolts are passed between the two halves. This is not only cumbersome but has the potential for disaster should the wind take hold of the higher piece before attachment is achieved. Further, the potential for loss or mislaid parts such as bolts washers and nuts are considerable.

Regardless of where 2-part dinghies are located when assembly takes place, the joining of two or more parts of a dinghy typically requires bringing together the transverse bulkheads of the separate segments of the craft and most frequently involves through-bulkhead bolts; conventionally the bulkheads are required to come face to face in tight configuration to achieve successful watertight joining of the craft (indeed, frequently the "bulkheads" are little more than peripheral enlarged partial joining segments rather than full or near full-depth bulkheads; such is the tightness of the said jointing systems currently employed).

Some dinghies are manufactured so as to achieve a connection while the two parts are afloat but these rely on maintaining the horizontal alignment of one part within which the occupant sits while floating the other half towards the individual in the dinghy prior to achieving connection, again by use of through bolting. The requirement here is therefore for a great depth of internal floatation material within the main segment of the dinghy thereby reducing the internal freeboard of the dinghy that is available for its intended purpose such as transporting people or goods.

Where alternative means to bolts have been employed it remains a universal feature of such devices that the two end bulkheads are required to come into full and complete transverse contact, often supplementing this need by devices such as compressible rubber seals as water will ingress between any openings within the end bulkheads if allowed to enter from outside the hulls of the respective segments of the dinghy.

There is then a need for secondary securing devices including special, separate channel means as well as screws, wing nuts and the like; there is also the need for very costly tooling to produce the described indentations in the ends of the adjacent bulkheads.

For example, U.S. Pat. No. 3,916,468 teaches bulkheads with vertical dove-tailed indentations and respective matching folded segments in the adjoining bulkhead that are tapered towards the bottom. This arrangement requires production via expensive and wasteful machining or folding of a very specialist nature involving only light weight and therefore flexible sheet material. The end result is that further tightening means must be found, and are herein described, for bringing and retaining the now wedged bulkheads in position; a position that because the wedging itself is problematic may well lead to jamming of the joint means.

The object of the present invention is to provide a dinghy that alleviates the above problem, or at least provides the public with a useful alternative. It is therefore a key feature of this dinghy that the space between the respective bulkheads will be a wet area. That is, it will be normal for it to fill with water to the same level as the water upon which the vessel floats. This water causes no detriment to the vessel either when it is under power or when it is stationary while afloat. As a consequence of this wet area, the height or depth of the bulkheads must be relatively close to the "freeboard" of the vessel and a seat covering this joint will be higher in relative terms than in a normal dinghy where it is somewhat lower. The differences are not highly significant but may feel somewhat strange to a person not used to the change. Depending upon the specific approach to manufacturing the joining system, the outer skin of the dinghy may protrude from one or other (or indeed partially from both) of the bulkhead in order to complete the effect of a continuous hull (apart from the obvious existence of a small gap between the two halves of the vessel).

SUMMARY OF THE INVENTION

In a first aspect the invention comprises a dinghy constructed of two separable sections, being a front and a rear section, and a connection means adapted to join the two sections together the connection means including at least one vertical rod on one section adapted to engage a vertical sleeve on the other section and wherein at least the front of the rod is of a circular configuration in its cross-section.

In preference the front section has a rear bulkhead, the rear section a front bulkhead the connection means integral with the bulkheads.

In preference one of the bulkheads includes three sleeves, the other bulkhead including three rods adapted to engage the sleeves to thereby couple the dinghy together.

In preference the sleeves and the rods extend are of a circular configuration.

In preference the rear bulkhead includes the sleeves and the front bulkhead the rods.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way.

Figure 1:
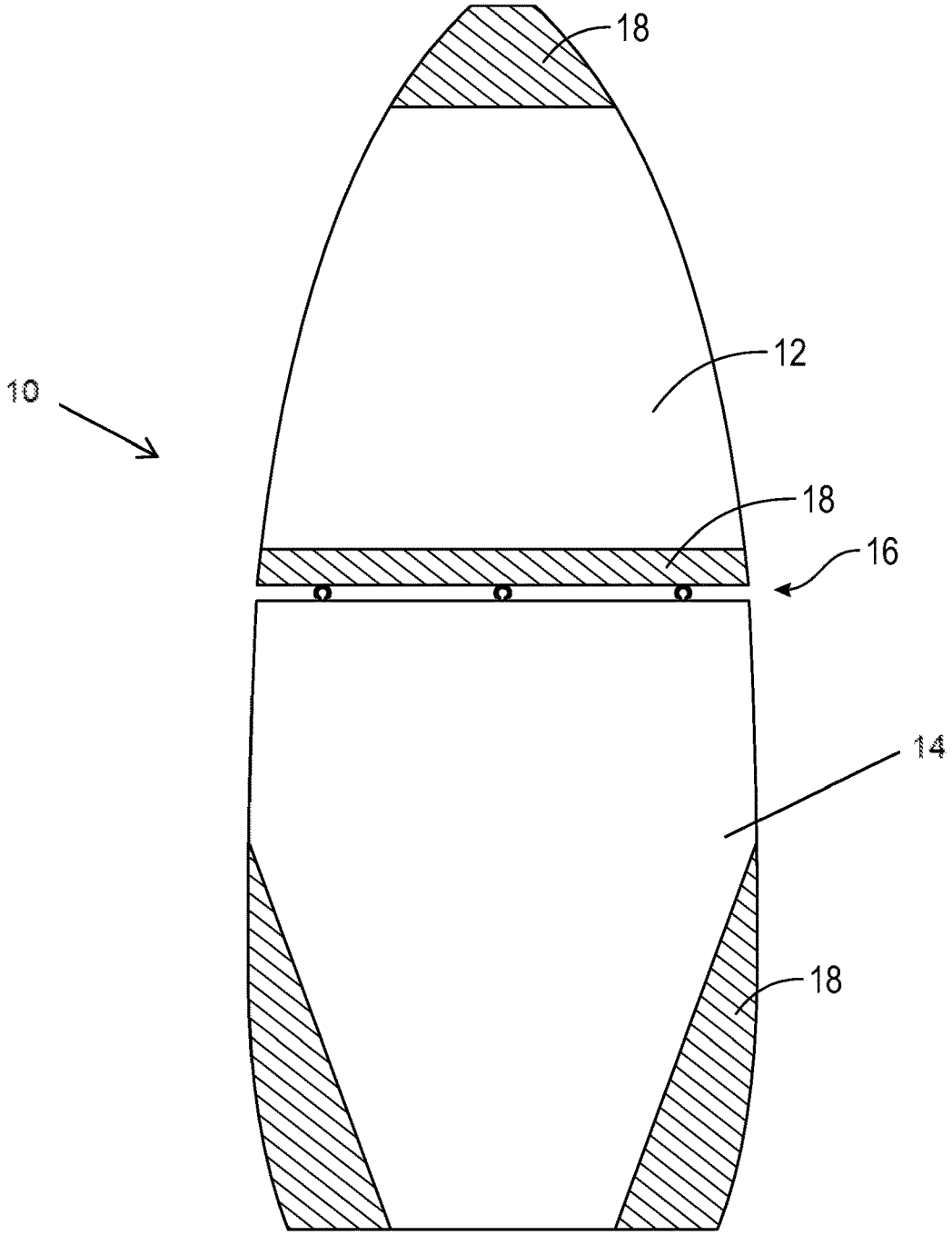
FIG. 1 is a top schematic view of a dinghy according to the present invention.

The Detailed Description will make reference to a number of drawings as follows.

DETAILED DESCRIPTION OF THE INVENTION

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated+ for the purposes of clarity or illustration.

Referring now to the Figures there is shown a dinghy 10 comprising of a separable front half 12 and rear half 14 that can be attached together using a joining means 16. Seats 18 are located on the front and rear halves 14. To join the sections together the rear half 14 includes vertical sleeves 20 and the front half 12 includes vertical rods 22 that are adapted to be inserted into the sleeves 20. Each rod 22 is supported by the front half using web 24 that is accommodated by slit 26 in the sleeve 20. Whilst illustrated as being of a circular configuration it is to be understood that the sleeves 20 and rods 22 may be of any appropriate cross-sectional shape, provided that the front of the rods 22 and the sleeves 20 are at least of a semi-circular shape.

Once the rods 22 are fully inserted into the sleeves 20 a locking means is provided to prevent the two sections from decoupling. For example, a bolt 28 fixed to the front half 12 engages a block 30, fixed to the rear half 14. The bolt 28 may be spring-loaded to ensure that it remains in place and a force has to be applied to retract it.

Figure 2A:
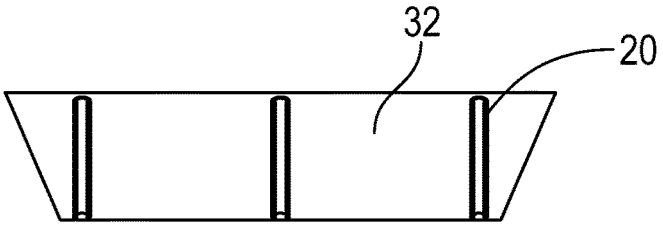
FIGS. 2*a, b, c* are views illustrating the connection means.
Figure 2B:
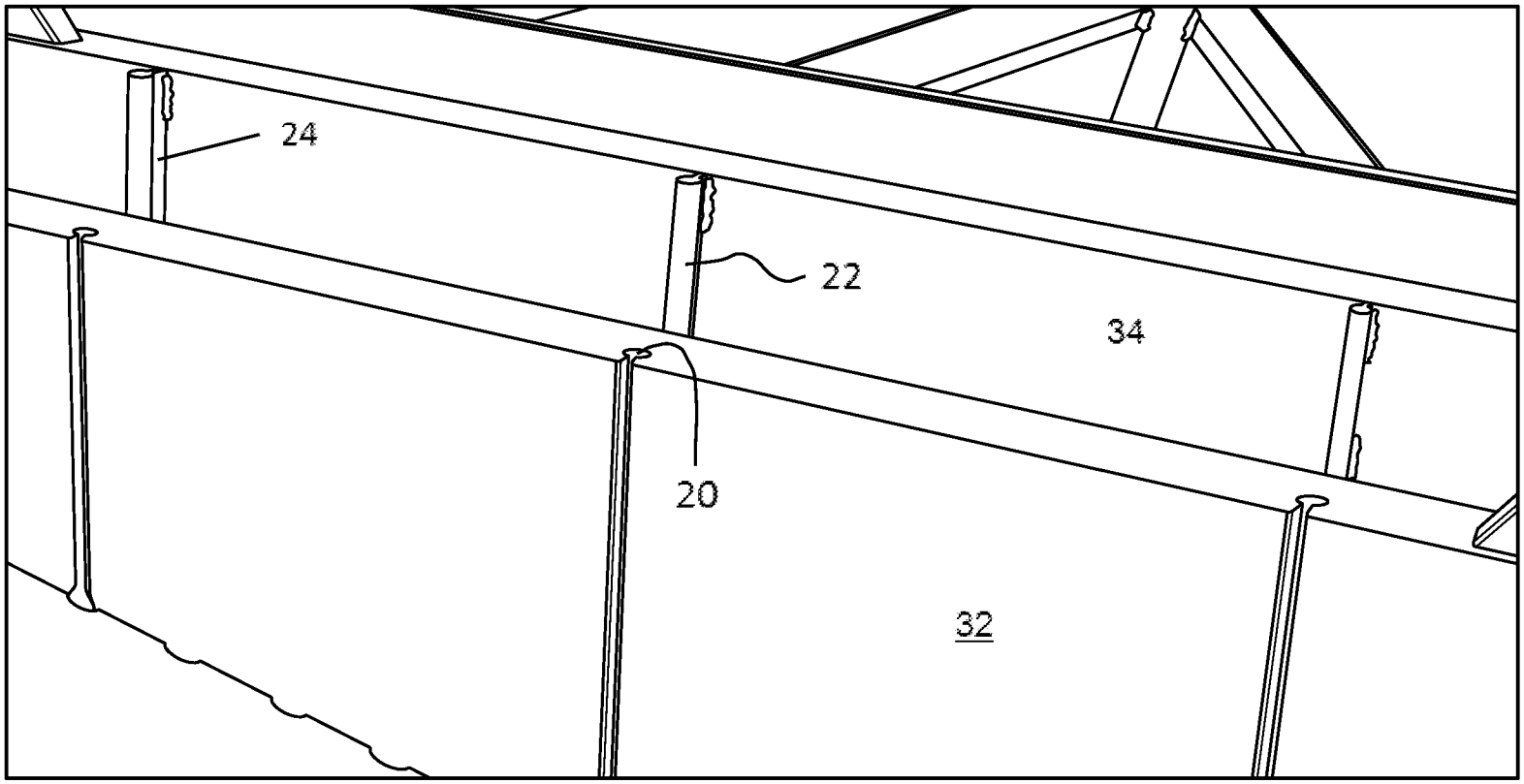
Figure 2C:
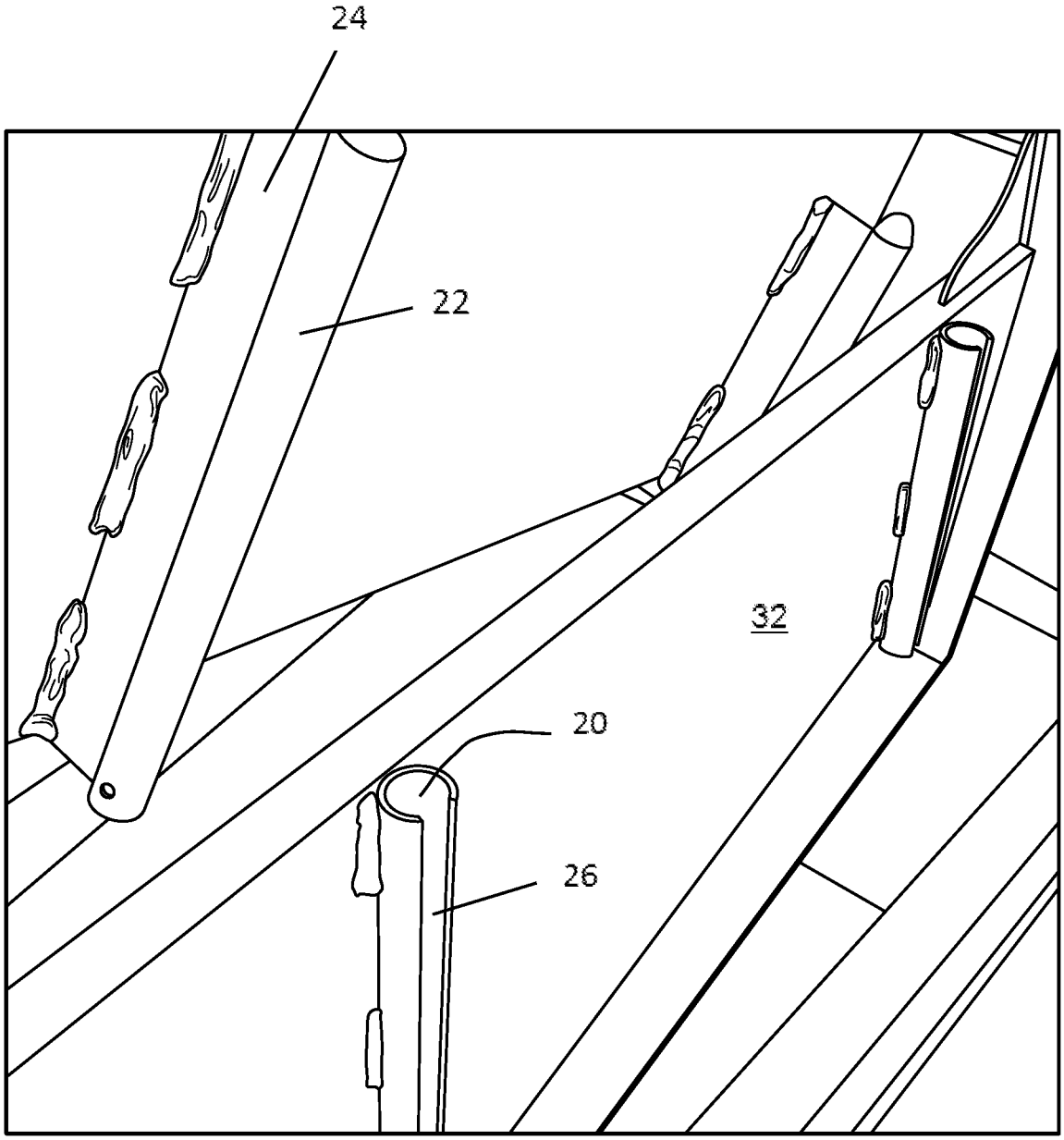
Figure 3:
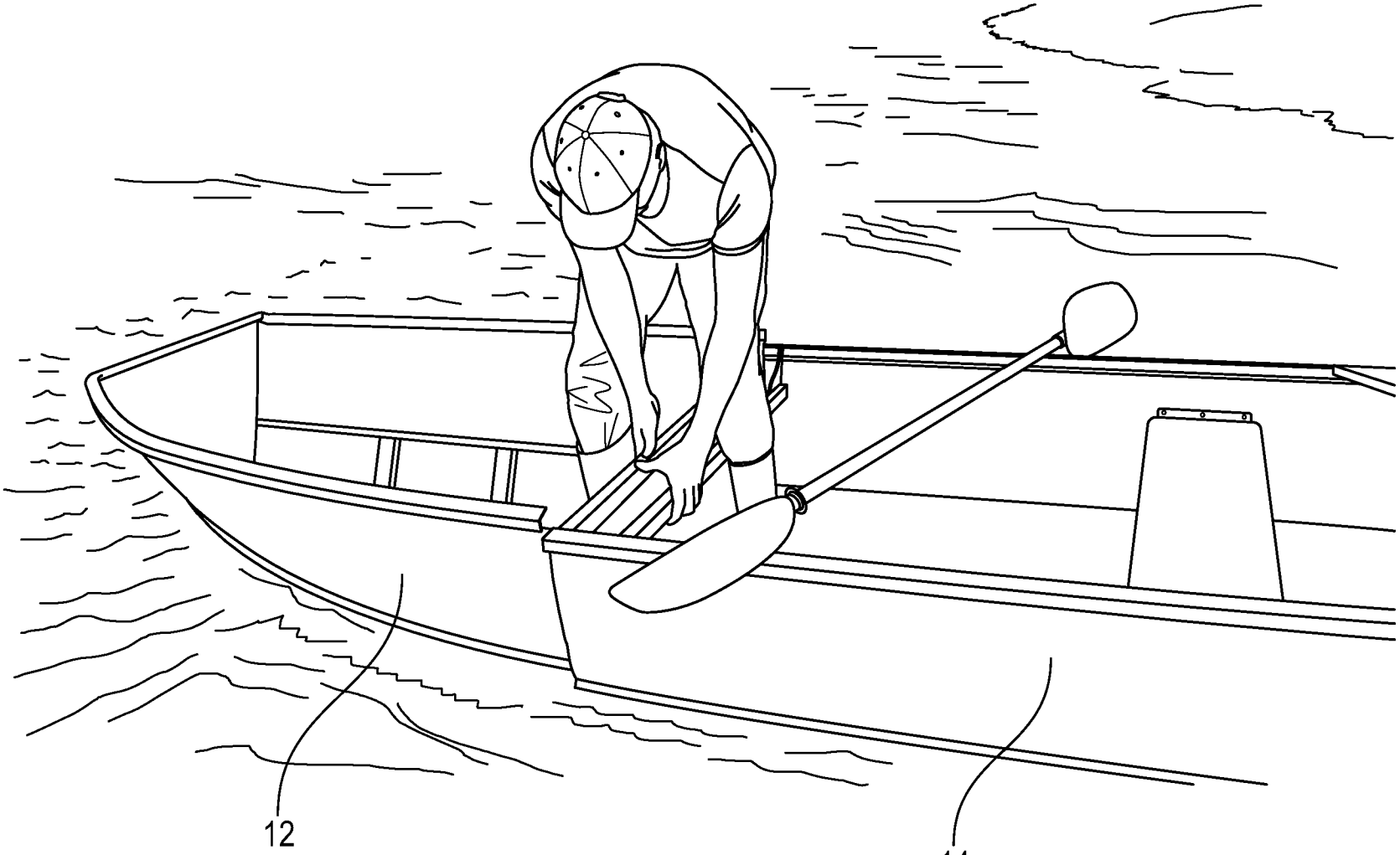
FIG. 3 illustrates the two parts of a dinghy being joined.
Figure 4:
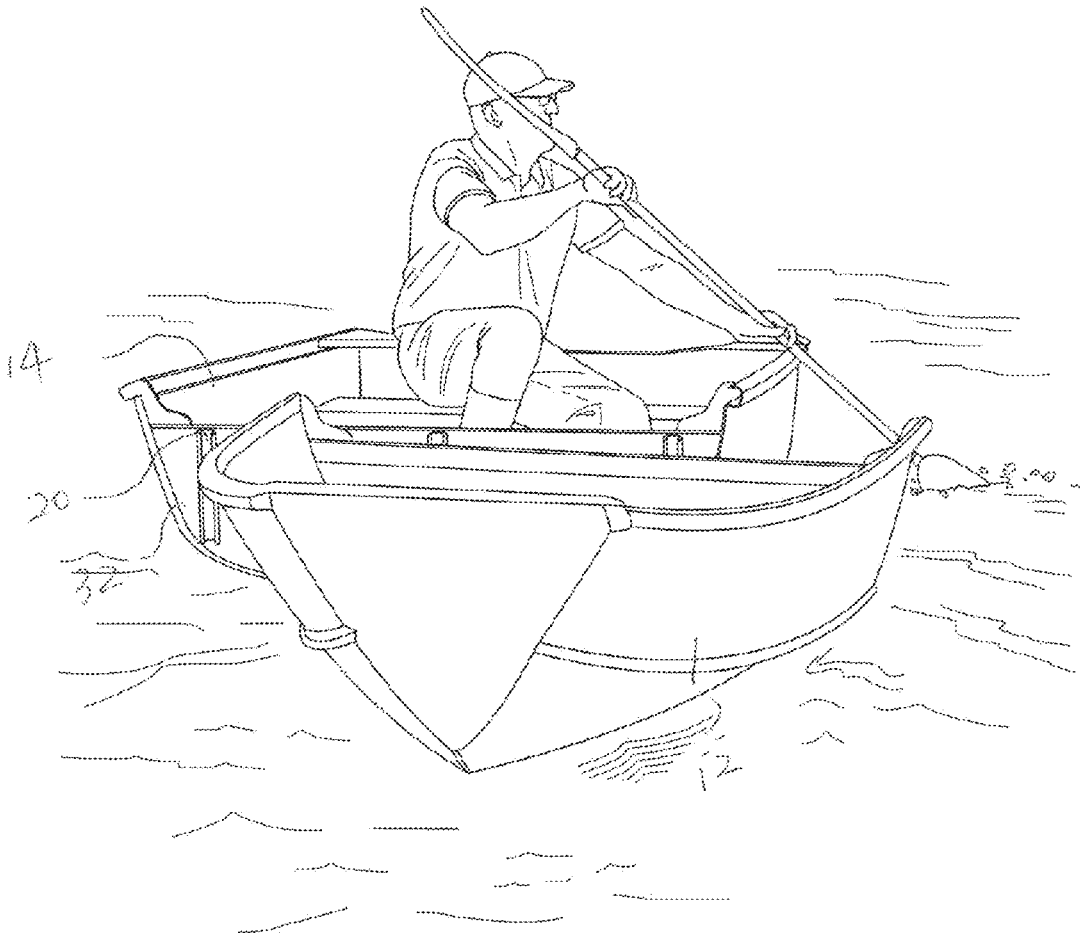
FIG. 4 illustrates the dinghy when the two parts are not joined.
Figure 5:
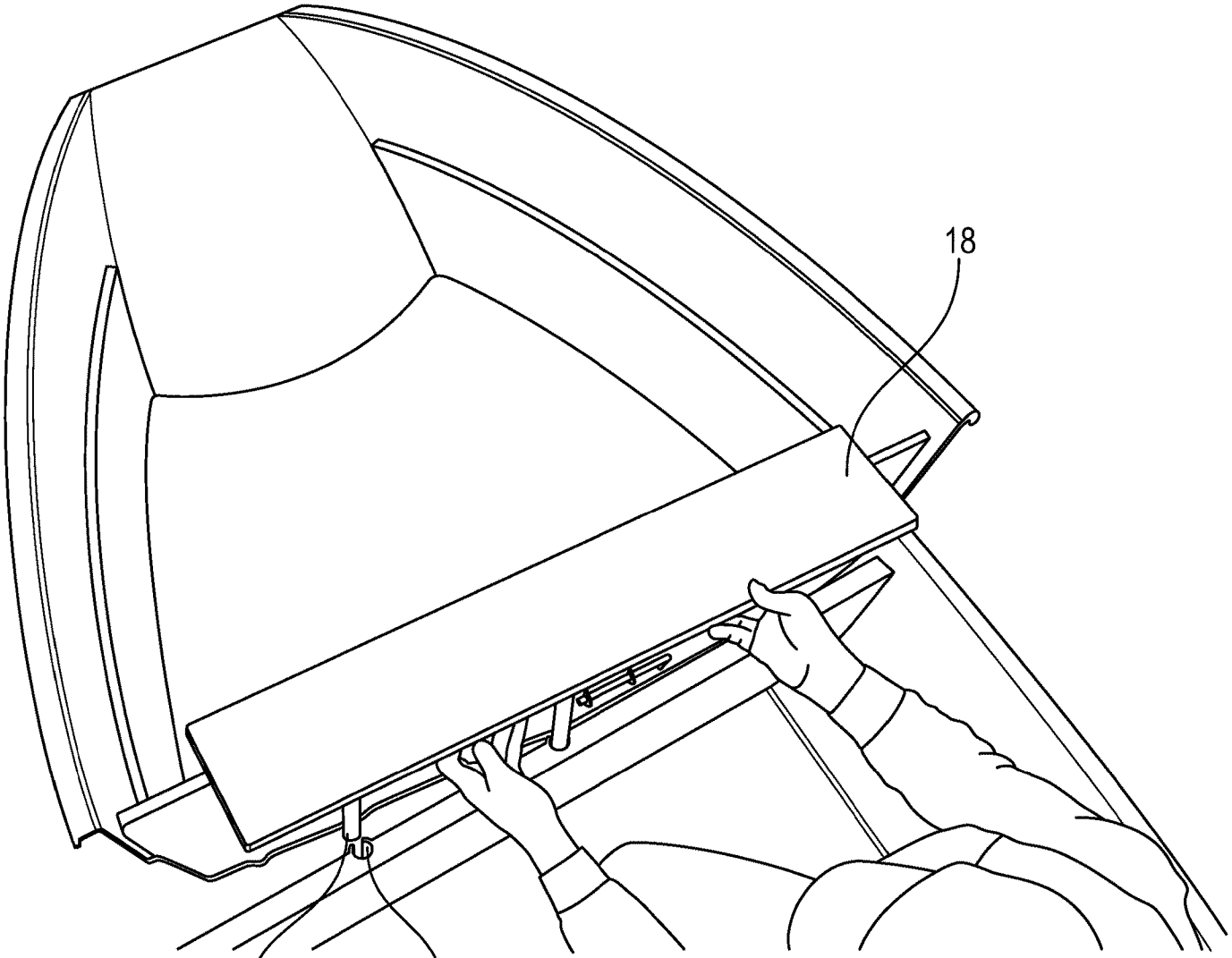
FIG. 5 illustrates one method of joining two parts of a dinghy.
Figure 6:
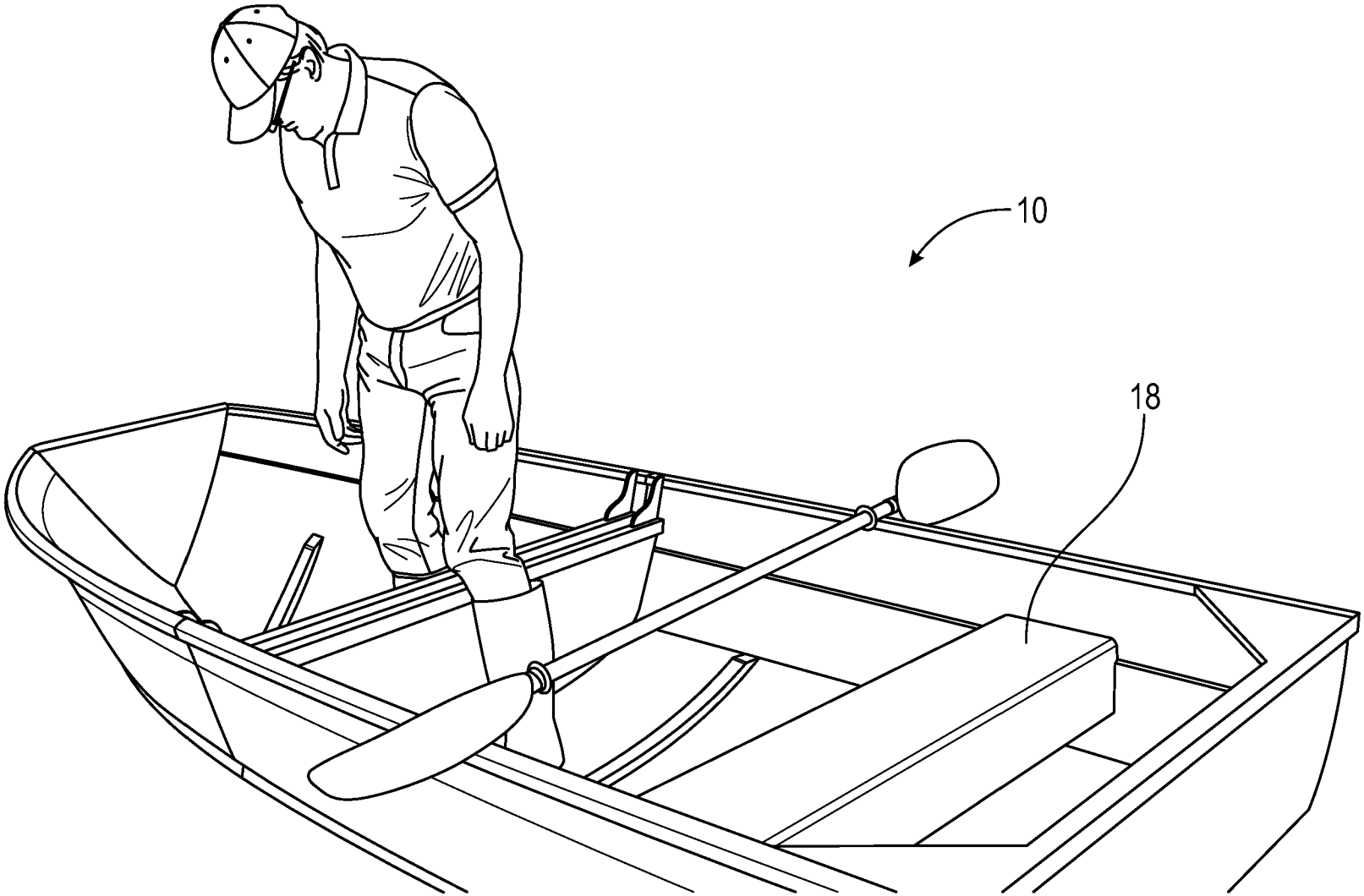
FIG. 6 illustrates a dinghy when two parts are joined.
Figure 7:
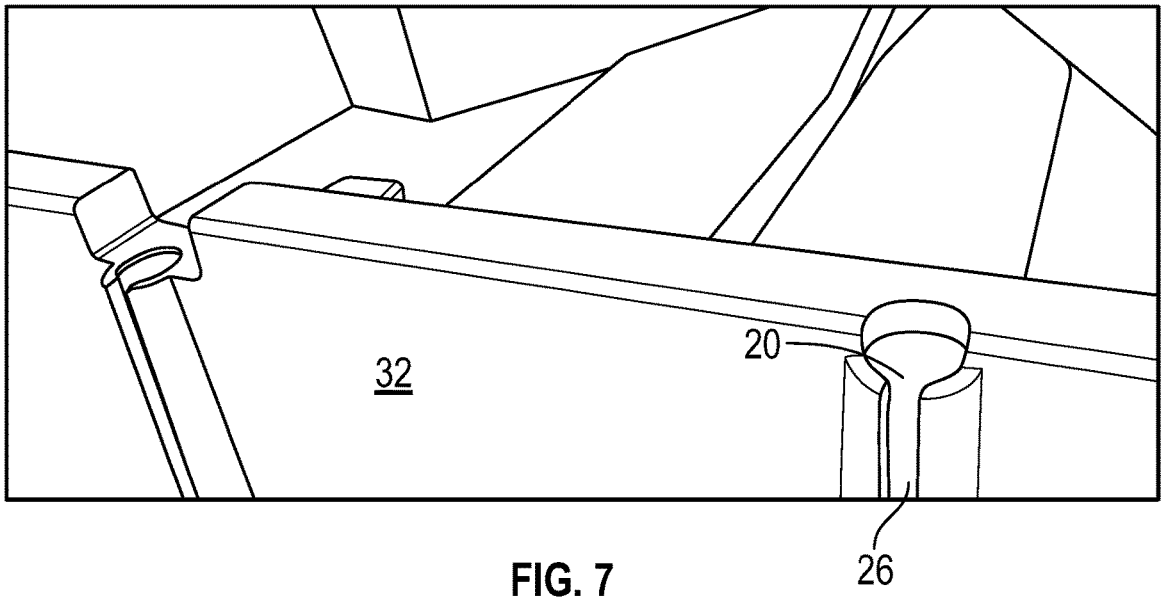
FIG. 7 is a partial view of the end of one part of the dinghy.
Figure 8:
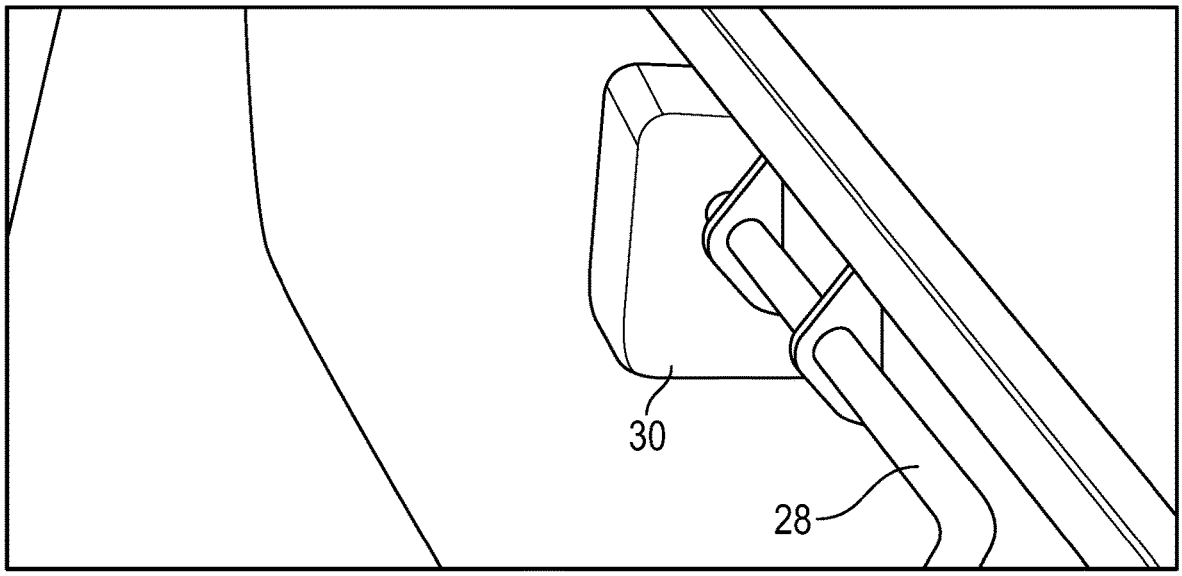
FIG. 8 is a partial view showing how the two parts of the dinghy are locked together.
Figure 9:
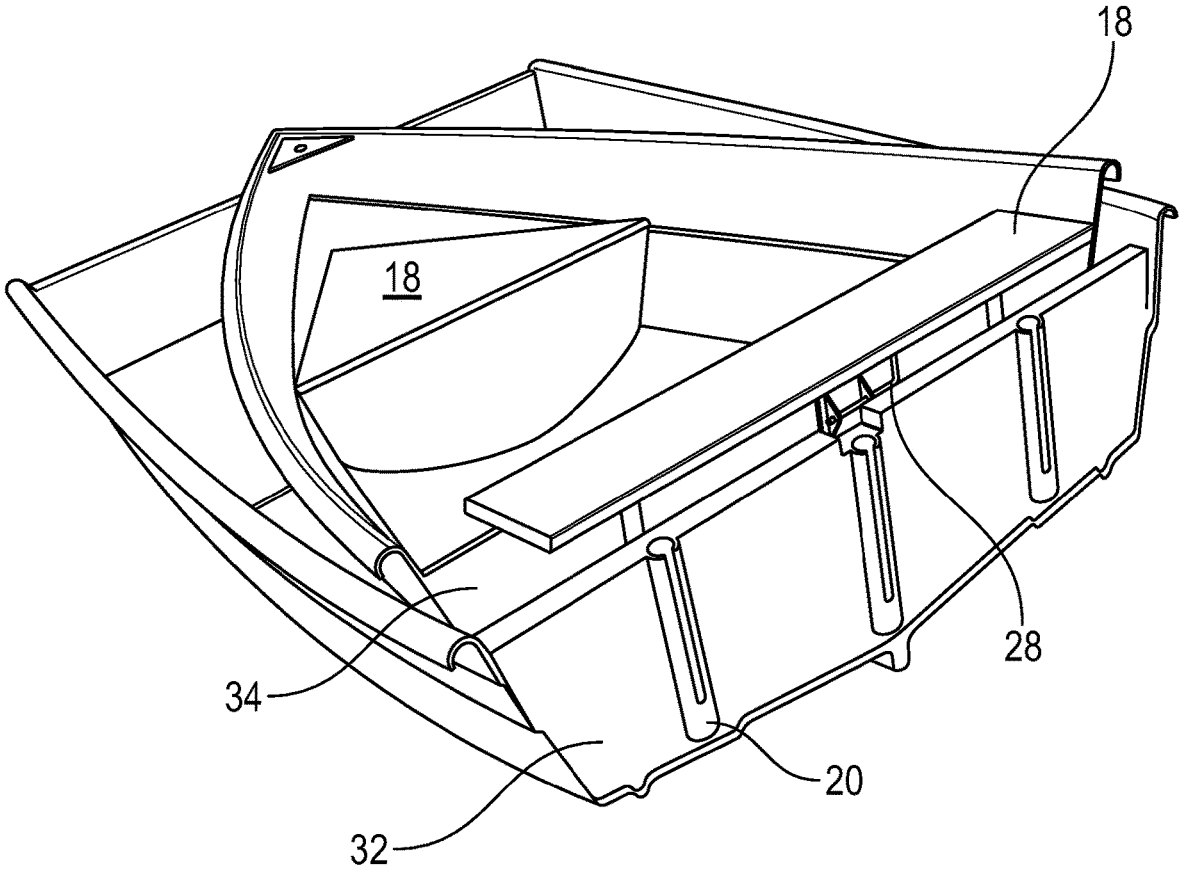
FIG. 9 illustrates how the dinghy can be stored when separated into two parts.

The sleeves 20 are illustrated in the FIG. 2C as extending beyond the front of the rear bulkhead 32, if the bulkhead is thick enough they could be wholly located within the front wall of the rear half 14 (FIG. 2B) so that when the two halves are joined together the rear bulkhead 34 of the front half 12 abuts the front bulkhead 32 of the rear half.

The above embodiment discussed a dinghy made up of two halves. It is however to be understood that a dinghy or a boat may be made up of several sections each connected to each other by the means described.

The reader should now appreciate the present invention. No part of either connecting end-bulkhead is breached by any connection means, and there is no need for detachable holding means to achieve the connection. There is nothing to become lost in transit so to speak; there are no bolts or similar connection means passing through the bulkheads. Further, apart from the possibility of incorporating the vertical tubes within the bulkhead of the "receiving" section of the dinghy and the tubes therefore forming a structurally integral part of the transverse bulkhead, there are no pre-formed indentations and related protrusions forming part of the bulkhead walls or disrupting the integrity of the bulkheads which under the present innovation are now separated by a distance that allows for "external" (or intra-bulkhead) connection means. It also allows for simple connection of the two parts of the dinghy while the two parts of the dinghy are afloat; the only requirement being that at least one of the two parts of the vessel is independently capable of supporting the weight of the person doing the assembling while the activity is taking place. There is therefore a minimum volume that at least one half of an intended 2-piece dinghy must have for the following connection means to be effective and safe.

The connection means consist of vertical tubes/sleeves on one bulkhead and reciprocally mounted rods on the facing bulkhead with splits in the tubes to allow entry of the rods as they are inserted at the upper side and slid downwards until the connection is complete. There is still an outer skin to the hull that extends throughout the length of the assembled dinghy as one half will carry the "internal" connection means recessed within the skin means (but still external to the end bulkhead) while the second half will have no skin means protruding beyond its end bulkhead yet will have protruding rods in vertical alignment for sliding into the opposite receiving tubes.

The rods and the sleeves may be tapered to allow for frictional engagement.

It is important to realise that this description is only one embodiment of the concept and that the rods and sleeves may be reversed in terms of which set goes on which bulkhead or indeed there may be a mixture of rods and tubes on opposite bulkheads; the end result will be the same: a solid connection of the two halves of the dinghy once vertical and horizontal alignment have been attained. It is also possible and may be advantageous with some materials to make the rods and tubes taper from "top" to "bottom" or indeed to employ a stepped taper or simply stepped diameter within the tubes and reciprocally stepped diameter of the joining rods. However, if any tapering is employed within the connection means there will need to be recognition of the tendency for tapered connections to become locked due to friction.

There are no bolts or extraneous pieces required to assemble or disaggregate the dinghy; the connection means are fixed, in situ, and not capable of being lost or separated from the two parts of the dinghy while it is disaggregated. Having thrown away the bolts so to speak, the manner and method of assembly of the two halves falls generally into two cases: on dry land or on the water. After assembly, the retention of the two halves in horizontal alignment may include bolts or other attachment means but none of these are required to pass through the bulkheads and none is needed that is not attached to one or other of the halves of the dinghy at all times.

On dry land, the manner of connection or disaggregation preferably requires two persons to be present to present the one half of the dinghy in a generally horizontal position to the remaining half but above its elevation so that a series of vertically spaced rods (typically three) attached to but external to its end bulkhead may be slid into matching vertical slotted receiving sleeves on the external face of its companion bulkhead. The alignment of the two halves is necessary and requires two persons to support the process as most people are not able to hold half a dinghy horizontally above the ground for a period long enough to align the connecting rods with their receiving tubes prior to allowing gravity to achieve the connection as the rods slide down into the slotted receiving tubes. Alternatively, one end of the dinghy may be placed on sloping ground such as a sloping beach where the other end may be presented in now less than horizontal position, allowed to rest there and then tipped upwards from the far end. It is possible but difficult for one person to achieve a connection while the dinghy is on dry land.

The central advantage of this method of achieving connection between two halves of a 2-piece dinghy is that pertaining to doing both these tasks while afloat. Providing that the larger (probably rear) portion of the dinghy has sufficient floatation capacity a single person standing or sitting in one part of the dinghy draws the other towards himself or herself so that the two separate bulkheads are roughly in transverse alignment with each other, then he or she raises the rear portion of the unoccupied segment so that the bottom end of the middle (assuming there are three) securing rod is brought to rest on the top of the central matching sleeve segment into which it is to slide. The rods (or tubes) to the side of this central connection will be found to be roughly in vertical alignment with their receiving opposites. To achieve a sliding together of the rods and their respective tubes all that is needed is for the person in the first segment to place a foot or hand within the second segment and press firmly downwards whereupon gravity will allow the two segments to slide together and achieve a complete connection. The advantage of this process, on the water, is that the weight of the occupant of the "receiving" end of the dinghy will depress the "receiving" bulkhead so that its vertical alignment is skewed towards the alignment of the "elevating" (unoccupied) segment of the dinghy and it's therefore similarly off-vertical skewed securing rods. In the above discussion, rods may be changed for tubes and vice-versa, and any combination from one set to another is possible.

Once in place, the two halves of the dinghy will need to be secured so that while on the water they are not liable to float apart in the vertical sense. This securing is probably best achieved by providing two or more tensioning clips that take the overlapping seat section of the forward segment vertically to the inner wall of the adjacent segment and force a closure by spring means. Alternatively, gate latches on both connecting inner wall sections where the respective hull segments meet above the height of the now secured and now "internally integrated" bulkheads would achieve the same purpose. Another means is to provide a ring-pull releasable spring-loaded automatic pin laterally within the outer wall of the central securing tube, near its upper end, that locates the pin into a hole within the securing rod to achieve a secure connection.

The purpose of separating two halves of a dinghy while in deep water is entirely related to the advantage obtained when raising the dinghy to the deck of a larger vessel. Disaggregating the two halves of the dinghy while on the water has been found to be very simply achieved. The benefit of differential floatation depending upon weight distribution between the two halves of the dinghy is that this differential is employed to separate the halves. The securing clips, pins, buckles, bolts, latches or whatever are removed first then the weight is transferred to one half (probably the rear half). At this point the lighter half will rise perhaps as much as half way to the point of separation. A simple reach lift over into this half (hand holds are found in framework at bulkhead upper side or through-seat hold and so forth) will allow this half of the dinghy to be lifted clear of its securing means. At this point there is a sudden change in buoyancy of the respective halves with the one containing the person now dropping some 35 percent or more of the depth of the bulkhead just to reflect the loss of the buoyancy previously provided by the (probably front) segment. This sudden drop in the now half dinghy is only of concern if the occupant is of extreme weight and advice would be given to pre-test the activity in shallow water before doing so in deep water. In practice, a 90+ kg person is found to cause a drop of about 10 cm in the bulkhead freeboard in a 3.3 m aluminium dinghy at the point of separation. If in any doubt, a heavy person would be advised to tie off both ends of the dinghy segment in which he or she was located to an overhead vessel portion or dock prior to letting the other half of the dinghy separate. Alternatively, a heavily built person might acquire the ability to keep one leg in each half of the dinghy and achieve separation simultaneously shifting weight from one leg to the other to compensate for the sudden change in buoyancy of the respective halves. Keeping one's weight well towards the centre of the dinghy portion would also be advised as this will lessen the risk of any overflow at the bulkhead end when the separation takes place. This may require some dexterity just prior to completing the separation.

The outer hull skin of the dinghy will probably protrude (depending upon design of both the rod and tube sections) from one or other (possibly both) side of the end joining planes in order to complete the effect of a continuous hull (other than a gap of a millimetre or two that is unavoidable). Various means may be found to "blunt" the end of such a skin segment to prevent undue damage in normal use of the dinghy. For example, a shallow outer but vertical segment may be added to the extremity of the hull segment (s) without interfering with the joining system. This segment is not designed to provide any form of watertight contact but merely for cosmetic effect; it will not impede the ingress of water to the gap between the two halves of the dinghy.

Because dinghies are bulky and expensive to transport it may well become the norm that only the joining parts of the dinghy, consisting of the two separate bulkhead end pieces (in pre-cut form) and their respective attached tubes and rods for joining the dinghy together may form a commercial construct and may (with the bulkheads to be finally cut to desired shape at the destination boatyard) be independently shipped from their point of manufacture to the end user boatyard for final assembly into a finished 2-piece dinghy.

One advantage of disaggregating a dinghy into two roughly equal length segments is that the smaller (usually front) section may be turned around in its horizontal orientation to the rear section and then nested within this rear section as a space saving device. This nesting will require changes to the seat arrangements within the rear segment to accommodate the forward section and seats so modified will need to contain buoyancy means such as foam or trapped air. The total buoyancy of the dinghy must always achieve required regulatory standards for safety purposes and this is achievable with varied approaches to design as well as supplementary means such as foam sections located between the securing tubes on the appropriate bulkhead of one or both segment ends. FIG. 1 illustrates in the shaded areas where foam or sealed air cavities may be installed to achieve required floatation for safety purposes.

LIST OF COMPONENTS

The drawings include the following integers:
Dinghy 10
Front half 12
Rear half 14
Joining means 16
Seats 18
Sleeves 20
Rods 22
Web 24
Slit 26
Bolt 28
Block 30
Front bulkhead 32
Rear bulkhead 34
Water line 36

Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

Thus it may be possible that the bulkheads are manufactured and sold separately that allows current dinghies to be cut and the bulkheads added to them to create a dinghy as per the present invention.

In the present specification and claims (if any), the word "comprising" and its derivatives including "comprises" and "comprise" include each of the stated integers but does not exclude the inclusion of one or more further integers.

The invention claimed is:

1. A dinghy constructed of two separable sections, comprising a front section and a rear section, and a connection means adapted to join the two separable sections together, and rods, wherein the rods are supported by a web extending from sleeves, wherein the sleeves include a slit to accommodate a web;

wherein the connection means includes at least one vertical rod of the rods on a first section adapted to engage a vertical sleeve on a second section and wherein at least a front of the at least one of the vertical rod of the rods has a cross-section with a curved perimeter.

2. The dinghy of claim 1, wherein the front section comprises a rear bulkhead, the rear section having a front bulkhead, and the connection means integral with the rear bulkhead and the front bulkhead.

3. The dinghy of claim 2, wherein the rear bulkhead further comprises sleeves and the front bulkhead further comprises rods.

4. The dinghy of claim 3 wherein the sleeves are at least partially defined within a first bulkhead of the bulkheads and the rods protrude from a second bulkhead of the bulkheads.

5. The dinghy of claim 1, wherein when the two separate sections are coupled together, thereby preventing the two separate sections from decoupling.

6. The dinghy of claim 1, further comprising a further middle section.

7. The dinghy of claim 1, wherein the sleeves and the rods are tapered.

8. The dinghy as in claim 3, wherein the front bulkhead supporting the rods includes a seat above the rods.

9. The dinghy of claim 1, wherein the web does not extend fully along the vertical rod and is shorter than the depth of the sleeves and the slit does not extend a full length of the sleeve.

10. The dinghy of claim 1, wherein the rods and the sleeve are of a circular configuration.

11. The dingy of claim 1, wherein the curved perimeter is circular.

* * * * *